United States Patent [19]

Hageman

[11] Patent Number: 4,521,478

[45] Date of Patent: Jun. 4, 1985

[54] IN SITU ROOFING COMPOSITE AND METHOD

[76] Inventor: John P. Hageman, 42 Susan Dr., Closter, N.J. 07624

[21] Appl. No.: 642,576

[22] Filed: Aug. 20, 1984

[51] Int. Cl.[3] ..... B32B 3/10; B32B 5/02; B32B 5/18; B32B 11/02

[52] U.S. Cl. ..... 428/287; 156/71; 428/150; 428/316.6; 428/318.4; 428/480; 428/489

[58] Field of Search ..... 156/71; 428/147, 150, 428/287, 291, 316.6, 318.4, 319.1, 480, 489

[56] References Cited

U.S. PATENT DOCUMENTS

| | | | |
|---|---|---|---|
| 3,094,447 | 6/1963 | Chamberlain | 428/489 |
| 3,332,779 | 7/1967 | Parker | 426/16 |
| 3,369,958 | 2/1968 | Fleeman | 428/489 |
| 3,763,614 | 10/1973 | Hyde et al. | 156/71 |
| 3,937,640 | 2/1976 | Tajima et al. | 428/489 |
| 3,967,032 | 6/1976 | Plotz et al. | 428/489 |
| 4,039,706 | 8/1977 | Tajima et al. | 428/489 |
| 4,107,375 | 8/1978 | Iwasaki et al. | 428/489 |
| 4,151,025 | 4/1979 | Jacobs | 156/71 |
| 4,186,236 | 1/1980 | Heitmann | 428/489 |
| 4,219,603 | 8/1980 | Thun | 428/489 |
| 4,230,762 | 10/1980 | Iwasaki et al. | 428/489 |
| 4,282,697 | 8/1981 | Spielan et al. | 156/71 |
| 4,357,377 | 11/1982 | Yamamoto | 428/489 |
| 4,368,228 | 1/1983 | Gorgati | 428/291 |

FOREIGN PATENT DOCUMENTS 2200881 7/1973 Fed. Rep. of Germany .
"Polyester: Stretching the Roof Market".

OTHER PUBLICATIONS

"Paving the way for HOT Polyester", by Teresa O'-Dea, 1984.
"Hageman's Polyester Felt Dominates Field", vol. 2, No. 1, 1982.
"Commerce", Mar. 1984.
"Hageman is Leader in Use of Polyester Felt".
"Cold Weather No Problem for Hageman Roofing".
"Hageman Roofing Moving at Record Pace".

*Primary Examiner*—William J. Van Balen
*Attorney, Agent, or Firm*—Robert S. Salzman

[57] ABSTRACT

The invention comprises a built-up roof material that has a composite membrane that is formed and affixed to the roof substrate in a single step. The membrane comprises a sheet of heat-resistant, non-woven polyester sandwiched between layers of asphalt. The upper asphalt layer is caused to flow through the polyester and meld with the lower layer of asphalt to form a homogeneous composite.

18 Claims, 3 Drawing Figures

IN SITU ROOFING COMPOSITE AND METHOD

FIELD OF THE INVENTION

This invention relates to roofing construction materials and methods, and more particularly to an in situ roofing composite and method of fabricating same.

BACKGROUND OF THE INVENTION

In recent times, the use of asphalt-impregnated polyester sheet for roofing construction has been found to provide excellent results. The polyester sheeting is generally treated with asphalt and other water-resistant materials in the factory, because of the difficulties experienced with applying water-proofing materials to the polyester at the roof site.

Untreated, non-woven polyester sheet does not generally withstand heat, and does not easily absorb hot asphalt.

Untreated, polyester sheet has been used with asphalt in cold-process roofing systems, wherein the asphalt is modified with latex or polypropylene and sprayed in a cold liquid state upon the polyester sheet. The cold process roofing systems have not been entirely satisfactory, because they tend to remain tacky for many months. This tackiness hinders the completion, repair and/or inspection of the roof, since the roof cannot be walked upon while tacky.

Even where hot asphalt systems have been contemplated with the use of polyester sheet, the asphalt generally requires torching on the roof, which is an unsafe, fire-hazardous procedure.

Therefore, most roofing applications using polyester materials have been with a polyestermat, i.e., a factory asphalt-impregnated polyester sheet.

The drawback of using factory impregnated polyester sheeting, however, is the high cost and inconvenience of shipping and handling these heavy rolls of material.

The present invention contemplates the construction of a roof using a polyester-hot asphalt or coal tar process at the roofing site, without the aforementioned disadvantages.

Hot, built-up roofing can now use plain, non-woven polyester sheet for the reasons that the polyester is now being manufactured with a resin treatment that assists the polyester to withstand the temperature (450 degrees F.) of hot asphalt and other hot-applied water-proofing ingredients.

In addition, torching the asphalt on the roof is no longer necessary with the advent of a new hot pumping system, wherein the asphalt is pumped in a hot fluid state to the roof.

The advantages of building-up a roof with hot water-proofing ingredients and polyester sheeting are many.

The rolls of plain, non-woven polyester sheet are light in weight and inexpensive to purchase and ship.

Plain polyester rolls are easier to work with, and a single, light-weight ply is often all that is required to produce an efficacious roof construction.

According to this invention, the polyester and asphalt layers can be melded together and simultaneously directly attached to the roof substrate as a composite membrane. This inventive method of forming and affixing a composite membrane simultaneously, in situ, not only reduces the costs of fabrication, but also provides a roof of better quality and adhesion.

The inventive method and construction will be explained in more detail, hereinafter.

The composite membrane technique of this invention can be used with different roof substrates and overlays of foam, such as polyurethane and isocyanurate, to provide a roof composite construction of exceptional durability.

DISCUSSION OF RELATED ART

The use of a woven polyester sheet for cold process roof systems using an emulsion of latex and asphalt is shown in German Pat. No. 2200881. This technique is not similar to this invention in that a cold process is used rather than a hot process, and a woven rather than a non-woven sheet of polyester is utilized. Such a system using an asphalt emulsion will remain tacky, and as such, is not practical.

In the U.S. Pat. No. 4,230,762, issued to Iwasaki et al; on Aug. 15, 1978, a non-woven fabric which is impregnated at the factory with asphalt, is described. This patent does not suggest using a plain, unpregnated polyester sheet in situ. As previously described, factory impregnated material is expensive to ship due to the added weight, and is further difficult to handle.

In U.S. Pat. No. 3,369,958, issued to H. Fleeman on Feb. 20, 1968, an embossed sheet of polythene or polyvinyl chloride is suggested as a material which can withstand the heat generated by hot asphalt roofing techniques. This patent does not suggest the specific use of polyester sheeting. Also, this patent does not suggest the flow of asphalt through the sheet to form a composite membrane, and one which can be directly applied in one step.

BRIEF SUMMARY OF THE INVENTION

This invention features a built-up, in situ roofing composite having a membrane that is both formed and affixed to a roof substrate in a single, simultaneous step. The roofing composite comprises a first layer of water-proofing ingredients applied to a roof substrate. The ingredients can be selected from a group consisting of asphalt, modified asphalt and coal tar.

Over this first layer, at least a single ply of non-woven polyester sheeting is laid. The polyester sheet has an approximate weight in the range of 4 to 14 ounces per square yard. Preferably, the polyester has a weight of approximately 5.5 to 7.5 ounces per square yard.

A second layer of water-proofing ingredients is applied over the polyester. The second layer of ingredients is allowed to flow through the polyester and meld with the first layer, thus forming a built-up composite membrane that is affixed to the roof substrate.

Over the membrane composite is applied a heat resistant layer of material, such as gravel, foam or a layer of mastic followed by granules. The foam may be a polyurethane or an isocyanurate. Similarly, the roof substrate may comprise a foam.

The polyester sheet may be embossed prior to its installation to give the sheeting improved suppleness and adhesion.

The composite roofing made in the above manner exhibits a durability uncommon with present day techniques and is substantially split-resistant.

It is an object of the invention to provide an improved roof composite and method of fabricating same.

It is another object of this invention to provide a roof composite that includes a membrane that is formed and affixed to the roof substrate in a single, simultaneous step.

These and other objects of the invention will be better understood and will become more apparent with reference to the subsequent detailed description considered in conjunction with the accompanying drawings.

DETAILED DESCRIPTION OF THE INVENTION

Generally speaking, the invention features a built-up, in situ roofing composite, wherein a water-proof membrane is formed and affixed to a roof substrate in a single fabricating step. The composite and method of its fabrication will be described with reference to FIGS. 1 through 3, wherein like elements have been assigned the same designation for the sake of brevity.

Figure 1:
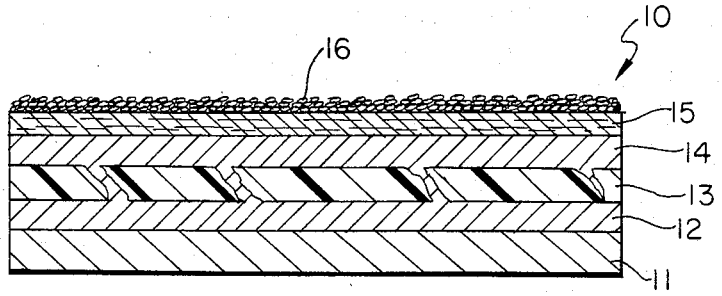
FIG. 1 is a sectional view of the roof composite of this invention.

Now referring to FIG. 1, a roof composite 10 attached to a roof substrate 11 is illustrated in a sectional view. The composite 10 is made up of several layers of materials, the first of which is a layer of asphalt 12. The asphalt can be applied in a temperature range of between 350 degrees F. to 480 degrees F. depending on the type of asphalt used, i.e., dead level, flat or steep. Modified asphalt (treated with latex) as well as coal tar may be used for layer 12.

Preferably a steep asphalt is applied. The asphalt is heated to 450 degrees F. in a temperature-controlled bulk tanker. The tanker keeps the asphalt at a constant temperature, critical for successfully applying polyesters.

Using a bulk tanker also enables the crew to start the job as soon as they get to the site, rather than having to wait for the asphalt to heat up. It provides a steady supply of hot asphalt, keeping production rates high. Plus, the tanker eliminates smoke and fumes, is safer than kettles, and uses less propane.

The asphalt is pumped up to an asphalt spreader or a small hot lugger. One mechanic spreads about 50 pounds per square feet of the hot asphalt with a mop.

Over the asphalt layer 12 is disposed a layer 13 of resin-treated, non-woven polyester. The resin treatment allows the polyester to withstand the heat of the asphalt.

As the asphalt is mopped onto the roof substrate 11, another worker unrolls a 50 lb. roll of the polyester sheeting into the asphalt layer 12.

Another worker then covers the polyester sheet layer 13 with another 50 pounds per square feet of asphalt, thus forming layer 14. The asphalt 14 is allowed to penetrate the polyester layer 13.

The polyester sheet is 68 mils thick, so it requires a lot of asphalt to fill the polyester layer 13.

The asphalt layer 14 is broomed into the polyester layer 13 to ensure good penetration. The asphalt is broomed sideways across the polyester, so that the polyester is not stepped on by the worker, and the underlayer of asphalt 12 is not displaced.

The penetrating asphalt layer 14 melds with the underlayer 12 and then rises back up through the polyester layer 13.

When the asphalt layer 14 is "broomed-in", a polyester and asphalt composite membrane is formed and securely attached to the roof substrate 11 all in one step.

Figure 2:
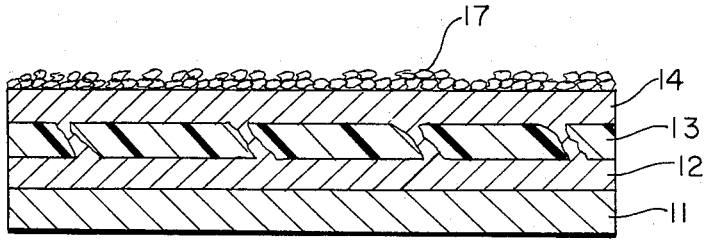
FIG. 2 is a sectional view of an alternate embodiment of the roof composite shown in FIG. 1.
Figure 3:
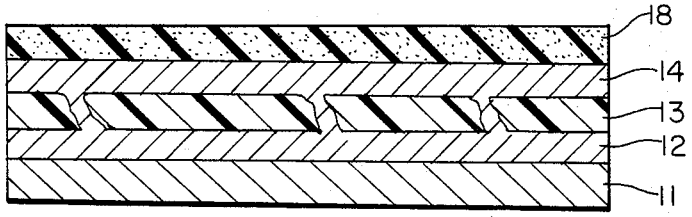
FIG. 3 is a sectional view of another alternate embodiment of the roof composite illustrated in FIG. 1.

The asphalt layer 14 must be shielded from the harmful ultraviolet rays of the sun. Also, the polyester layer 13 must be kept cool. Therefore, a heat-resistant insulating layer is required over the asphalt layer 14. FIGS. 1 through 3 show three different ways of covering the membrane composite.

FIG. 1 illustrates a first method wherein a mastic layer 15 is coated over asphalt layer 14, and then a layer of ceramic granules 16 is embedded in the mastic layer 15.

The mastic layer 15 comprises asphalt in a solvent, such as mineral spirits. Asbestos or fiberglass may be added to the mastic composition.

The granules 16 are poured into a ground-level machine manufactured by Kold-King of Denver, Colo. that pumps them to the roof and sprays them over the mastic layer 15.

In FIG. 2, a layer 17 of gravel is directly applied on top of the asphalt layer 14.

In FIG. 3, a layer 18 of foam is applied over the asphalt layer 14. The foam can be a polyurethane or an isocyanurate made by the Upjohn Company.

The substrate 11 of the roof can be the roof top surface or it may comprise a foam applied over the top surface. The foam for the substrate 11 can also be a polyurethane or isocyanurate.

The foam in layers 11 and/or 18 can be sprayed or applied in blocks or sheets.

The polyester sheeting can be laid in single, double or triple ply. The polyester sheet can range in weight from 4 to 14 ounces per square yard.

The resin-treated non-woven polyester sheet is made by the Hoechst Company, New Jersey under the tradename of Trivera ®.

Another polyester sheet that can be used in hot-roofing systems is made by Du Pont Co. of Wilmington, Del., called Reemay Hot. This sheet is a polyester and fiberglass laminate.

The granules 16 are type 11 made by the 3 M Company of Bellmede, N.J. Granules can also be purchased from GAF Corporation.

The mastic can be purchased from the Monsey Corporation of East Rutherford, N.J.

The asphalt can be purchased from the Exxon Corporation.

The roof composite of this invention is substantially split-resistant. This is very significant, since the major cause of failure in contemporary roofing is splitting.

Having thus described the invention, what is desired to be protected by Letters Patent is presented by the subsequently appended claims.

What is claimed is:

1. A built-up, in situ roofing composite, comprising:

a first layer of water-proofing ingredients applied to a roof substrate, said ingredients selected from a group consisting of asphalt, modified asphalt and coal tar;

at least a single ply of non-woven polyester sheeting overlaying said first layer;

a second layer of water-proofing ingredients applied over said polyester, said second layer flowing through said polyester and melding with said first layer to form a built-up composite membrane which is affixed to said substrate; and an insulating, heat-resistant layer of material disposed over said built-up composite membrane forming a roofing composite that is substantially split-resistant.

2. The built-up roofing composite of claim 1, wherein said insulating layer comprises a material selected from a group consisting of gravel, granules and heat-resistant foam.

3. The built-up roofing composite of claim 2, wherein said foam comprises a polyurethane.

4. The built-up roofing composite of claim 2, wherein said foam comprises an isocyanurate.

5. The built-up roofing composite of claim 1, wherein said polyester has a weight in a range of approximately 4 to 14 ounces per square yard.

6. The built-up roofing composite of claim 5, wherein said polyester has a weight in an approximate range of 5.5 to 7.5 ounces per square yard.

7. The built-up roofing composite of claim 1, wherein said polyester is embossed.

8. The built-up roofing composite of claim 1, wherein said roof substrate comprises a foam material.

9. The built-up roofing composite of claim 2, wherein said insulating material comprises granules, and further comprising a layer of mastic disposed between said second layer and said granules.

10. A built-up, in situ roofing composite, comprising:

a first layer of asphalt applied to a roof substrate;

at least a single ply of non-woven polyester sheeting overlaying said first layer;

a second layer of asphalt applied over said polyester, said second layer flowing through said polyester and melding with said first layer to form a built-up composite membrane which is affixed to said substrate; and an insulating, heat-resistant layer of material disposed over said built-up composite membrane, said insulating layer including a layer of mastic covered by granules.

11. A method of fabricating in situ, a roofing composite, comprising the steps of:

(a) applying a first layer of water-proofing ingredients to a roof substrate;

(b) overlaying said first layer with at least a single ply of polyester sheeting;

(c) applying a second layer of water-proofing ingredients over said polyester;

(d) causing said second layer of water-proofing ingredients to flow through said polyester and meld with said first layer of water-proofing ingredients to form a composite membrane which is affixed to said substrate; and (e) covering said composite membrane with a heat-resistant insulating layer.

12. The method of claim 11, wherein said water-proofing ingredients comprise asphalt, and wherein said applying step (c) includes mopping said asphalt upon said polyester, said asphalt being in a temperature range of approximately 350 degrees F. to 480 degrees F.

13. The method of claim 11, wherein said water-proofing ingredients comprise asphalt, and wherein at least one of said applying steps (a) or (c) includes spraying said asphalt layer.

14. The method of claim 11, wherein said covering step (e) includes applying a layer of gravel over said composite membrane.

15. The method of claim 11, wherein said covering step (e) includes applying a layer of mastic upon said composite membrane and overlaying said mastic with granules.

16. The method of claim 11, wherein said covering step (e) includes spraying a layer of heat-resistant foam over said composite membrane.

17. The method of claim 11, further comprising the step of:

(f) embossing said polyester sheeting prior to said overlaying step (b).

18. The method of claim 11, wherein said covering step (e) includes placing blocks of insulating material over said composite membrane.

* * * * *